United States Patent [19]

Coddens et al.

[11] Patent Number: 4,478,366

[45] Date of Patent: Oct. 23, 1984

[54] VENTILATION SYSTEM FOR REDUCING THE HUMIDITY IN AN ATTIC OR ROOF CAVITY SPACE

[76] Inventors: Donald L. Coddens, 60189 Fellows St., South Bend, Ind. 46614; Paul D. Van Belle, 1507 South 13th St., Niles, Mich. 49120

[21] Appl. No.: 513,626

[22] Filed: Jul. 14, 1983

[51] Int. Cl.[3] ..... F24F 3/14

[52] U.S. Cl. ..... 236/44 A; 236/13; 165/16

[58] Field of Search ..... 236/44 R, 44 A, 13; 165/16, 21

[56] References Cited

U.S. PATENT DOCUMENTS

| | | | |
|---|---|---|---|
| Re. 26,430 | 8/1968 | Beeler | 165/16 |
| 2,128,096 | 8/1938 | Loepsinger | 236/44 A |
| 2,131,725 | 10/1938 | Chester | 236/44 R X |
| 2,287,268 | 6/1942 | Palmer | 236/44 A |
| 2,389,440 | 11/1945 | Kucher | 236/44 R X |
| 3,625,022 | 12/1971 | Johnson | 165/16 X |
| 3,669,349 | 6/1972 | Hall, Jr. | 165/16 X |
| 3,720,258 | 3/1973 | Chandler | 165/16 X |

*Primary Examiner*—William E. Tapolcai

*Attorney, Agent, or Firm*—Eugene C. Knoblock

[57] ABSTRACT

A roof cavity venting system which draws in outside air, mixes it with inside air in the roof cavity to heat the cold outside air and dehumidify the inside air, and expels the mixture into the home living quarters. The system includes exterior and interior ventilation units, a power-driven fan unit mounted in the ceiling between the living quarters and the roof cavity, and a heating element for heating the air which is drawn through the fan unit.

3 Claims, 5 Drawing Figures

VENTILATION SYSTEM FOR REDUCING THE HUMIDITY IN AN ATTIC OR ROOF CAVITY SPACE

BACKGROUND OF THE INVENTION

In the maintenance of energy efficient tightly constructed manufactured housing a large problem is presented during the cold winter months by the accumulation of living area humidity and excessive moisture, in the roof cavity above. This problem is caused by the accumulation of warm humid air in the living area some of which permeates and accumulates within the roof cavity. Moisture condensation and excessive humidity within the roof cavity reduces the efficiency of ceiling insulation which in time mats and compresses the insulation rendering the insulation ineffective. If cavity moisture buildup becomes too great, the ceiling below will sag and become water laden and water spotted and the exterior walls of the living areas will become wet and warped. Prior solutions to this problem include attempting to seal the roof cavity, but this is neither desirable nor practically possible due to migration of heat and moisture from the living quarters into the attic. Another prior solution has been to vent the attic only. This removes some moisture from the attic but does not affect the quality of the air in the living quarters. Also, with this system warm air is continuously removed from the attic during winter months to create a greater temperature gradient between the roof cavity and living quarters ceiling thereby increasing living area heating costs.

SUMMARY OF THE INVENTION

This invention relates to an attic or roof cavity venting system which draws air into the attic space of a modular home from the outside, mixes it in the attic with inside living quarters air, heats the mixture, and expels the mixture into the living quarters.

The venting system preferably includes two passive gable ventilation units between the outside air and the roof cavity space which open and close in response to roof cavity temperature and a plurality of ceiling shutters which adjust to control the amount of air passing from the living quarters into the roof cavity space. The venting system also includes a power-driven fan unit which is mounted in the ceiling in communication between the living quarters and the roof cavity and which has a heating element for heating the air as it is drawn through the unit. The fan unit is normally idle and is activated for a limited period of time in response to the humidity level in the roof cavity. Upon activation of the fan unit, outside air is drawn into the roof cavity through the passive vents and mixed with air from the living quarters drawn into the roof cavity through the ceiling shutters. The mixed air is heated to temper the air as it is blown into the living quarters. In this manner, the humidity in the roof cavity space and living area is reduced and the quality of living area air improved. When it is not desirable to operate the fan unit, such as during the seasons when the relative humidity of the outside air is high, the fan unit may be rendered inoperative for any length of time by a manual override switch. Ventilation of the roof cavity space then occurs through the gable passive ventilation units.

Accordingly, it is an object of this invention to provide a novel and useful ventilation system for the roof cavity spaces of manufactured and modular dwellings such as mobile homes.

Another object of this invention is to provide a ventilation system which improves tne quality of air in the dwelling.

Another object of this invention is to provide a ventilation system which prevents the accumulation of moisture in a roof cavity space.

Yet another object of this invention is to provide a ventilation system which draws outside relatively dry air into the roof cavity space mixes it with air from the living area and heats the mixture to temper the air as it is blown into the living area.

Other objects of this invention will become apparent upon a reading of the following description.

DESCRIPTION OF THE PREFERRED EMBODIMENT

Figure 1:
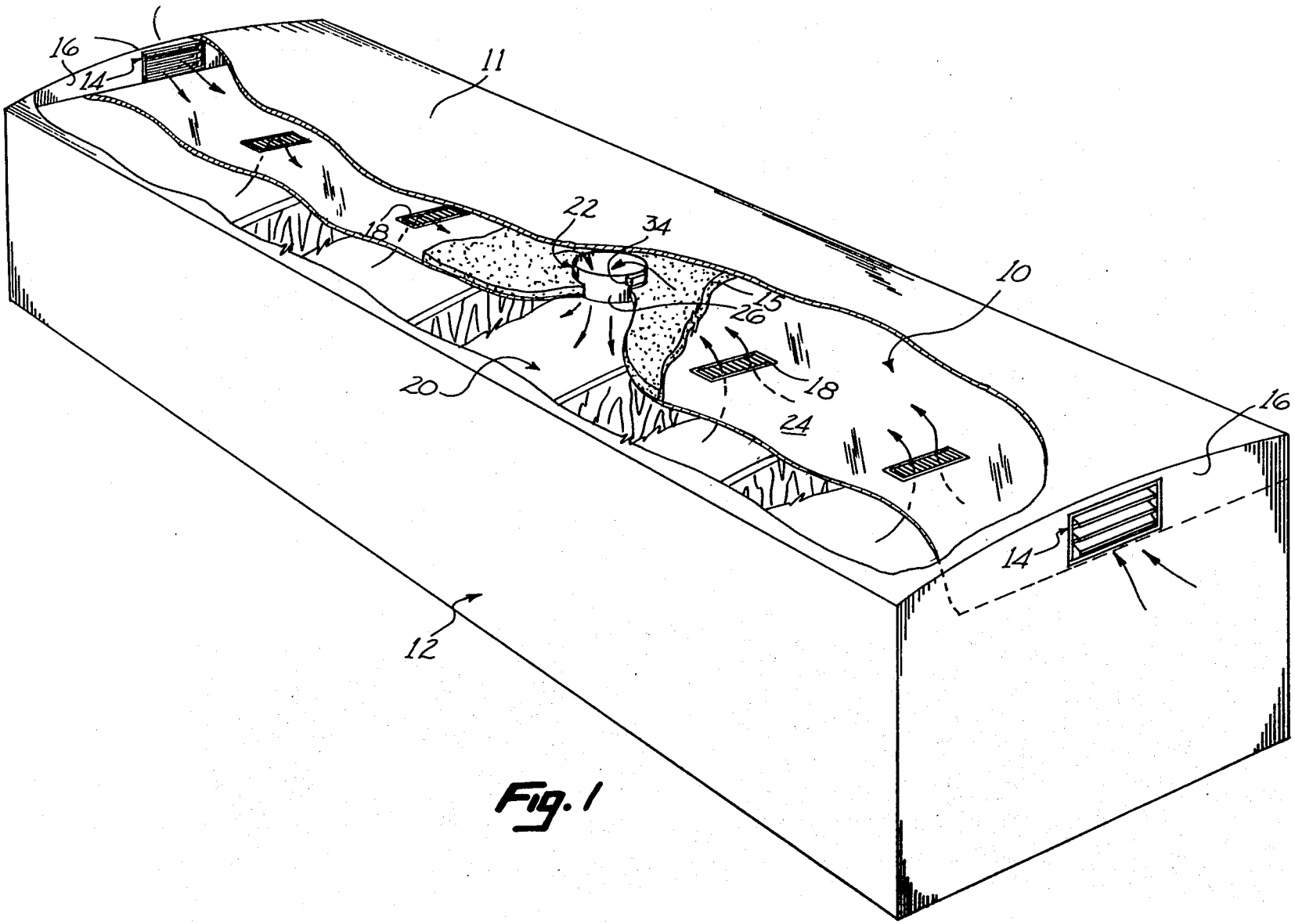
FIG. 1 is a perspective view of a housing unit with the ventilation system of this invention installed and having portions broken away for purposes of illustration.
Figure 4:
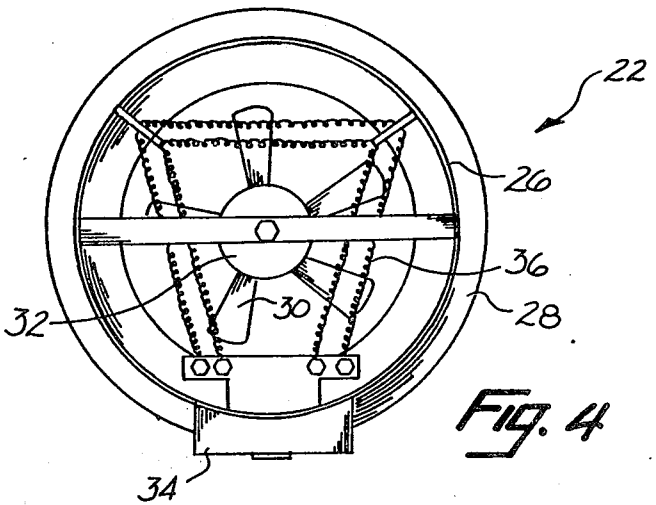
FIG. 4 is a top plan view of the heater-fan used in the ventilation system.
Figure 3:
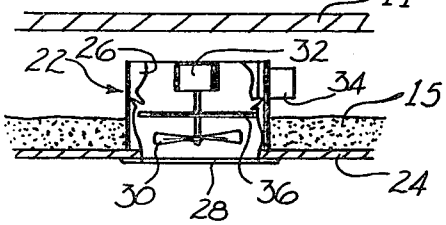
FIG. 3 is an enlarged view of the circled area of FIG. 2 with portions broken away for purposes of illustration.
Figure 2:
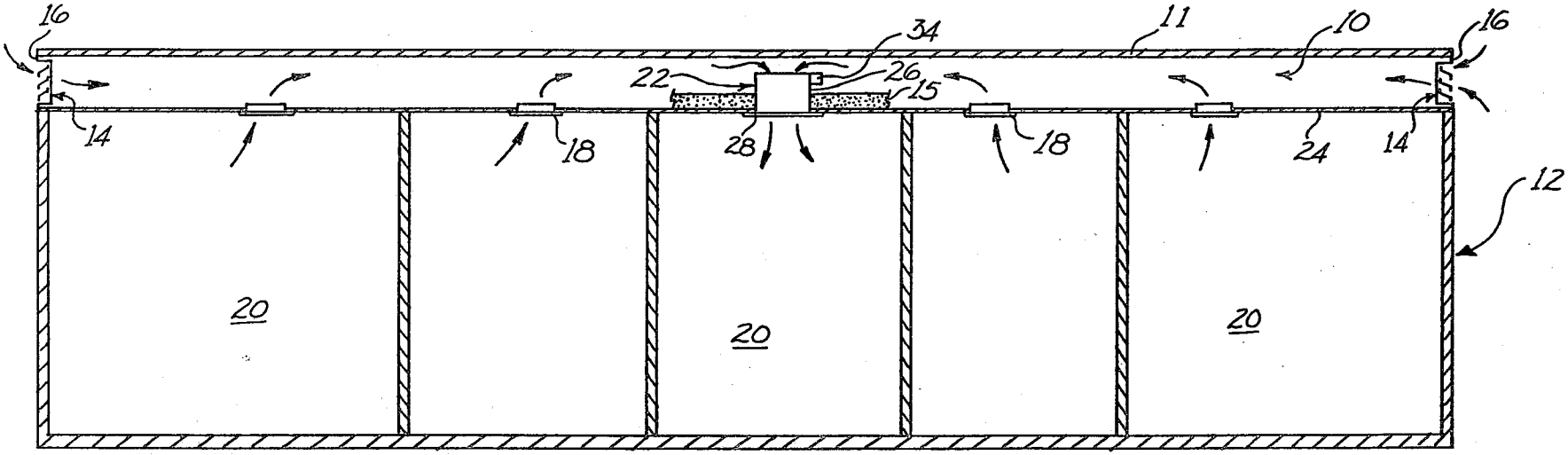
FIG. 2 is a longitudinal sectional view of a housing unit with the ventilation system of this invention installed and having portions removed for purposes of illustration.

The preferred embodiment illustrated is not intended to be exhaustive or to limit the invention to the precise form disclosed. It is chosen and described in order to explain the principles of the invention and its applicaton and practical use to thereby enable others skilled in the art to utilize the invention.

While the ventilation system of this invention is intended primarily for use with modular and mobile homes having generally small roof cavity spaces for removing the humidity from the space between the roof 11 and ceiling 24 of such a home 12, it may be adapted to use in other types of housing having a roof cavity or attic area. The ventilation system shown preferably includes a pair of temperature responsive gable vents 14 placed in the roof cavity wall 16 to allow communication between the cavity air and the outside air. Each temperature responsive vent 14 has a mechanism for opening and partially closing the vent in response to ambient temperature and may be of the type more fully described in U.S. Pat. No. 3,528,606. Temperature responsive vents 14 are adjustable and constructed to be in a partially open, such as 10–15 percent position, when the ambient temperature falls to 40° F. or below, and in a fully opened position when the ambient temperature is 70° F. or higher.

Several ceiling vent registers or shutters 18 are placed in home ceiling 24 between the living quarters 20 and roof cavity 10 of the home. Each ceiling shutter 18 includes adjustable sized openings so as to render the ceiling shutter infinitely adjustable between a fully opened and a fully closed position. Ceiling registers 18 have been used in conjunction with temperature responsive vents 14, to provide cooling of the home and a passive system for reducing the humidity in the home roof cavity.

The ventilation system of this invention also includes a fan unit 22 placed in home ceiling 24 with air communication between the unit and shutters 18 and vents 14. Fan unit 22 includes a cylindrical housing 26 which extends above the attic insulation 15. A grill 28 spans the opening at the end of housing 26 which extends into living quarters 20. An electric motor driven fan 30 is mounted within housing 26. The motor 32 for fan 30 is activated in response to a humidistat control 34 electrically connected to the motor. Humidistat 34 preferably activates fan motor 32 when the humidity level in attic 10 reaches 65% relative humidity, and deactivates the fan motor when the humidity level is lowered to 61% relative humidity. Fan unit 22 also includes a heating element 36 which is located above fan 30 and which is similarly activated by humidistat control 34 to heat and temper the air which is drawn by the fan and expelled through housing 26 into the home living quarters 20.

In the use of the vent system of ths invention, heat and moisture from living quarters 20 rises upwardly through ceiling 24 by conduction and through ceiling shutters 18 by convection increasing the moisture level in the cooler temperatures found in roof cavity 10. As such moisture accumulates, the humidity level rises until humidistat control 34 activates fan motor 32 and heating element 36. Fan 30 draws drier air from the outside into roof cavity 10 through temperature responsive vents 14. Fan 30 also simultaneously draws warm air from living quarters 20 into roof cavity 10 upwardly through ceiling shutters 18. The mixture of air drawn into roof cavity 10 is preferably 80% outside air and about 20% air from living quarters 20. As the dry outside air is mixed with the air already within roof cavity 10 and the warm air from living quarters 20, the relative humidity of the air mixture in the roof cavity is lowered to reduce condensation. This air mixture is drawn through cylindrical housing 26 by fan 30, heated by heating element 36, and expelled into the home living quarters 20. In this manner the humidity level in living quarters and roof cavity 10 is lowered and the air within living quarters 20 is freshened with outside air and recirculated throughout the home 12. This has beneficial effects upon the health of the occupants of home 12 and may supplement the overall home furnace use since the air from the outside is heated before being blown into living quarters 20.

Figure 5:
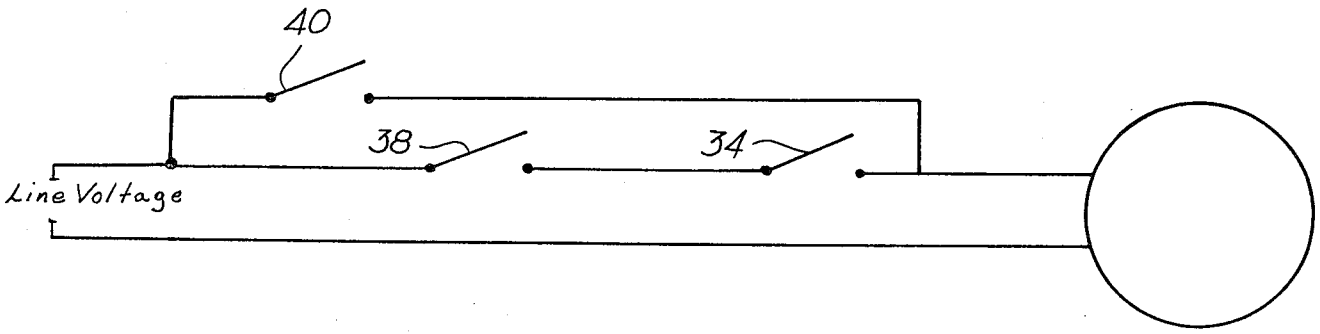
FIG. 5 is a diagram of the electrical connection of the fan unit.

It should be recognized that the venting system will not be operable to reduce the humidity level in roof cavity 10 during warm humid weather as the outside air would not greatly reduce the humidity level of air existing within the roof cavity. For this purpose a switch 38, shown in FIG. 5, is provided which has a summer (open) and winter (closed) position. The winter or closed position of switch 38 activates the humidistat control 34 and the summer or open position deactivates the humidistat control. A manual override switch 40 is also provided as illustrated in FIG. 5, so that an occupant of home 12 may selectively activate fan unit 22 when desired. Such selective activation of fan unit 22 may be needed to circulate air throughout home 12, or to rid living quarters 20 of undesirable odors, fumes, or other annoying substances. Although not shown, a second manual switch could be used in conjunction with switch 40 to deactivate heating element 36 when summer venting may be desired. Switches 38 and 40 are conveniently located within the home living quarters.

It should be understood that the invention is not limited to the terms of the above description but may be modified within the scope of the appended claims.

We claim:

1. A ventilation system in a home including living quarters and roof cavity space separated by a ceiling, said ventilation system including a vent between said roof cavity space and ambient outside air, a register in said ceiling between said living quarters and said roof cavity space, the improvement wherein the ventilation system includes a fan unit, said fan unit having a housing, said housing mounted in said ceiling in communication between said roof cavity space and said living quarters and including a motor operated fan mounted within said housing and humidity detecting switch means for activating the fan when the humidity level in said roof cavity space reaches a predetermined point and deactivating the fan when the humidity level reaches a lower predetermined point, said fan constituting means for drawing outside air into said roof cavity space through said vent and drawing air from said living quarters into said roof cavity space through said register whereby said outside and living quarters air is mixed and expelled into said living quarters.

2. The ventilation system of claim 1 wherein said fan unit includes heating means mounted within the air flow path of said fan for heating said outside and living quarters air mixture as it is expelled into said living quarters.

3. The ventilation system of claim 2 wherein said heating means is activated by said humidity detecting switch means.

* * * * *